US006761194B1

(12) United States Patent
Blong

(10) Patent No.: US 6,761,194 B1
(45) Date of Patent: Jul. 13, 2004

(54) INERT GAS DISPENSER FOR PROPANE TANKS

(76) Inventor: Dennis Blong, 2405 Curtis Dr., Penngrove, CA (US) 94951

( * ) Notice: Subject to any disclaimer, the term of this patent is extended or adjusted under 35 U.S.C. 154(b) by 0 days.

(21) Appl. No.: 10/721,661

(22) Filed: Nov. 25, 2003

(51) Int. Cl.[7] ..... B65B 1/04

(52) U.S. Cl. ..... 141/98; 221/66; 221/312 R; 221/29 B; 700/231

(58) Field of Search ..... 141/2, 18, 98; 221/66, 312 R, 29 B; 700/231, 232, 242

(56) References Cited

U.S. PATENT DOCUMENTS 4,778,042 A 10/1988 Warren et al.
5,829,630 A 11/1998 Fernald
6,192,296 B1 * 2/2001 Colmant et al. ..... 700/237
6,695,019 B2 * 2/2004 Hasenkopf ..... 141/98

FOREIGN PATENT DOCUMENTS

FR 2 641-887 A1 7/1990

* cited by examiner

*Primary Examiner*—Steven O. Douglas
(74) *Attorney, Agent, or Firm*—Woodard, Emhardt, Moriarty, McNett & Henry LLP

(57) ABSTRACT

A system for dispensing a plurality of pressurized tanks. The system includes a plurality of compartments each having a door that is releasably opened by a fluid operated lock connected to a pressurized line. The pressurized line is connected via a fluid operated control at a location remote from the lockers. A door sensor associated with each locker senses whether the door is in an open or closed position and a floor sensor sense whether a tank is absent from the particular locker or whether a filled or unfilled tank is present.

16 Claims, 7 Drawing Sheets

INERT GAS DISPENSER FOR PROPANE TANKS

BACKGROUND OF THE INVENTION

The present invention relates generally to the field of dispensing machines for propane tanks.

DESCRIPTION OF THE PRIOR ART

Propane is a liquefied petroleum gas and is stored in a variety of tanks for use in industrial and residential use. Upon exiting the pressurized tank, the propane changes state from a liquid to gas. The residential application of propane includes use as a fuel for cooking grills and a variety of appliances. The U.S. Department of Transportation has established standards for the tanks which are referred to as D.O.T. containers or cylinders. One such tank 20, illustrated in FIG. 1, includes a cylindrical and hollow main body 21 having a rounded bottom end resting upon and fixedly attached to a ring 22. The ring provides a base for tank 20 to rest. Gas within the tank is controllably released via a standard, commercially available, gas valve 23 mounted atop the tank. A valve safety wall or collar 24 is fixedly mounted atop the tank and partially surrounds valve 23. A plurality of slots or openings 25 are provided in wall 24.

A current practice is for the user to take an empty propane tank to a tank servicing location, such as a grocery store, a gasoline filling station or other retail establishment, and to trade in the empty tank for a propane filled tank. Generally, the propane servicing is provided by the retail establishment as a sideline with the tanks being stored externally of the building for safety reasons. Tanks typically are stored in a steel mesh cage and may also include a central supply of propane utilized to fill the smaller tanks. Thus, the current procedure is for the retail salesman to take time away from the principal business, exiting the building, unlocking and then opening the tank storage cage and inserting the empty tank while retrieving a propane filled tank. In the meantime, additional retail personnel are required within the building to service the principal customers and to monitor the checkout lines. What is needed is a personnel-free, automatic machine for receiving the empty tanks and for dispensing propane filled tanks. Disclosed is such a combination and method.

Vending machines are known for dispensing tanks of compressed gas such as shown in U.S. Pat. No. 5,829,630 issued to Fernald and U.S. Pat. No. 4,778,042 issued to Warren et al. An automatic dispenser of liquefied gas bottles is disclosed in the French Patent 2641-887-A. Disclosed herein is a fluid control system that unlocks individual lockers containig filled propane tanks. Fluid operated sensors associated with each locker detect if the locker door is closed after the propane tank is removed, further detect the presence of a tank within a locker and whether the tank in the locker is filled or unfilled.

SUMMARY OF THE INVENTION

One embodiment of the present invention includes a frame forming a plurality of individual lockers each for holding a propane tank. Doors are mounted to the frame adjacent each of the lockers. Fluid operated locks are mounted to the frame and engageable between the frame and the doors to lock the doors in the closed positions. Fluid operated weight sensors are mounted to the frame within each of the lockers to measure the weight of a tank positioned within a locker. A plurality of fluid lines extend from the locks and the sensors to a source of pressurized fluid. A control apparatus controls fluid flow to the locks for activation thereof and to receive data from the fluid operated weight sensors for determination of the presence of a filled or unfilled tank.

Another embodiment of the present invention includes a method of dispensing propane tanks comprising the steps of inserting a plurality of filled propane tanks into a plurality of lockers, and closing the door for each of the plurality of lockers. An unlocking command is sent via a fluid line from a control apparatus to a fluid operated lock. The selected propane tank is removed from the particular locker and data is sent to the control apparatus via the fluid line connected to a fluid operated tank sensor of the particular locker. The data corresponds to whether a filled or unfilled tank is present in the particular locker.

It is an object of the present invention to provide a combination of propane tanks and a machine for automatically dispensing the tanks.

In addition, it is an object of the present invention to provide a new and improved method for dispensing tanks of propane.

Another object of the present invention is to provide a dispenser of propane tanks in plurality of lockers each having fluid operated door locks, door sensors and tank sensors.

Related objects and advantages of the present invention will be apparent from the following description.

DESCRIPTION OF THE PREFERRED EMBODIMENT

Figure 1:
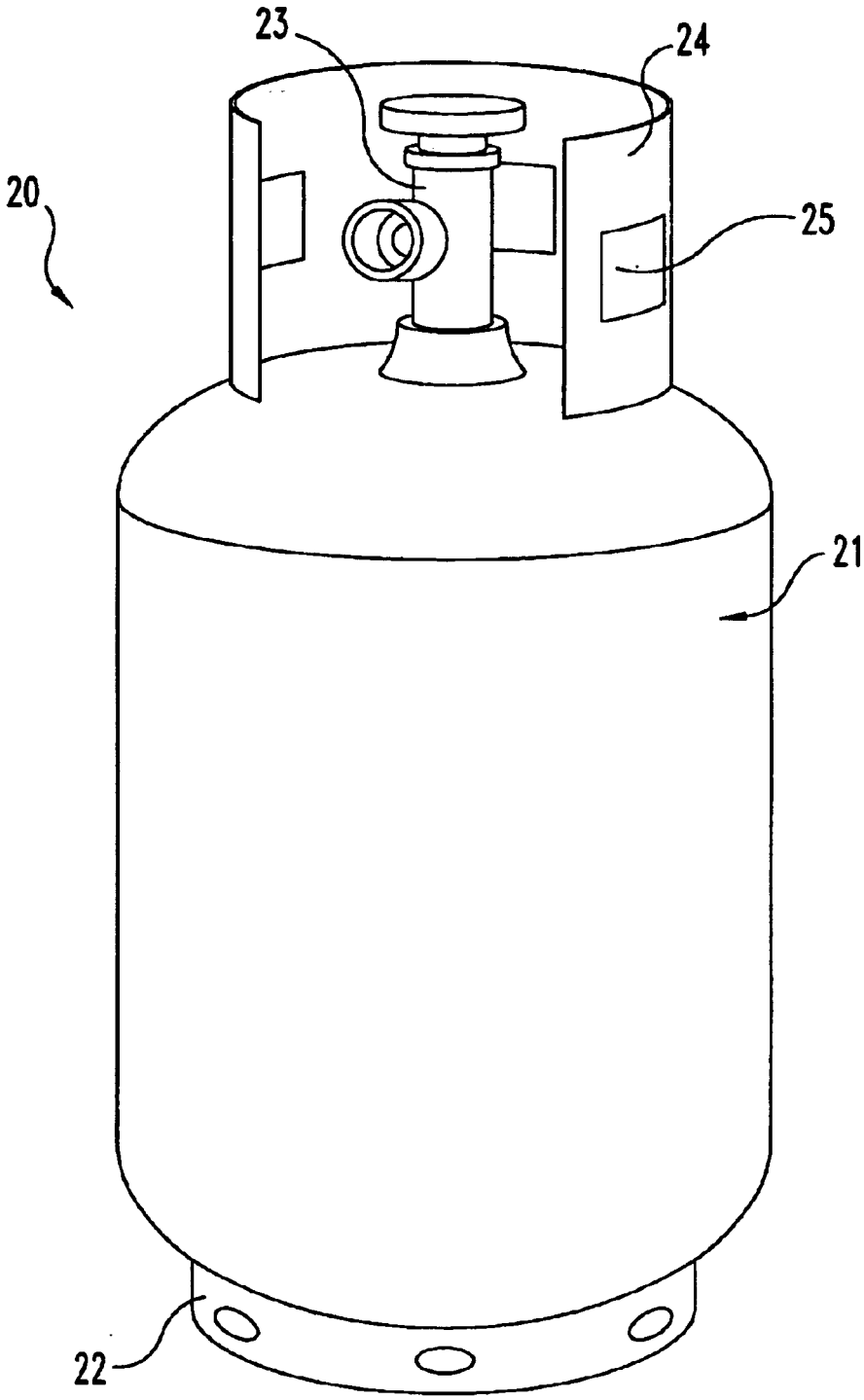
Fig. 1 (PRIOR ART)
FIG. 1 is a perspective view of the prior art D.O.T. propane filled tank.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
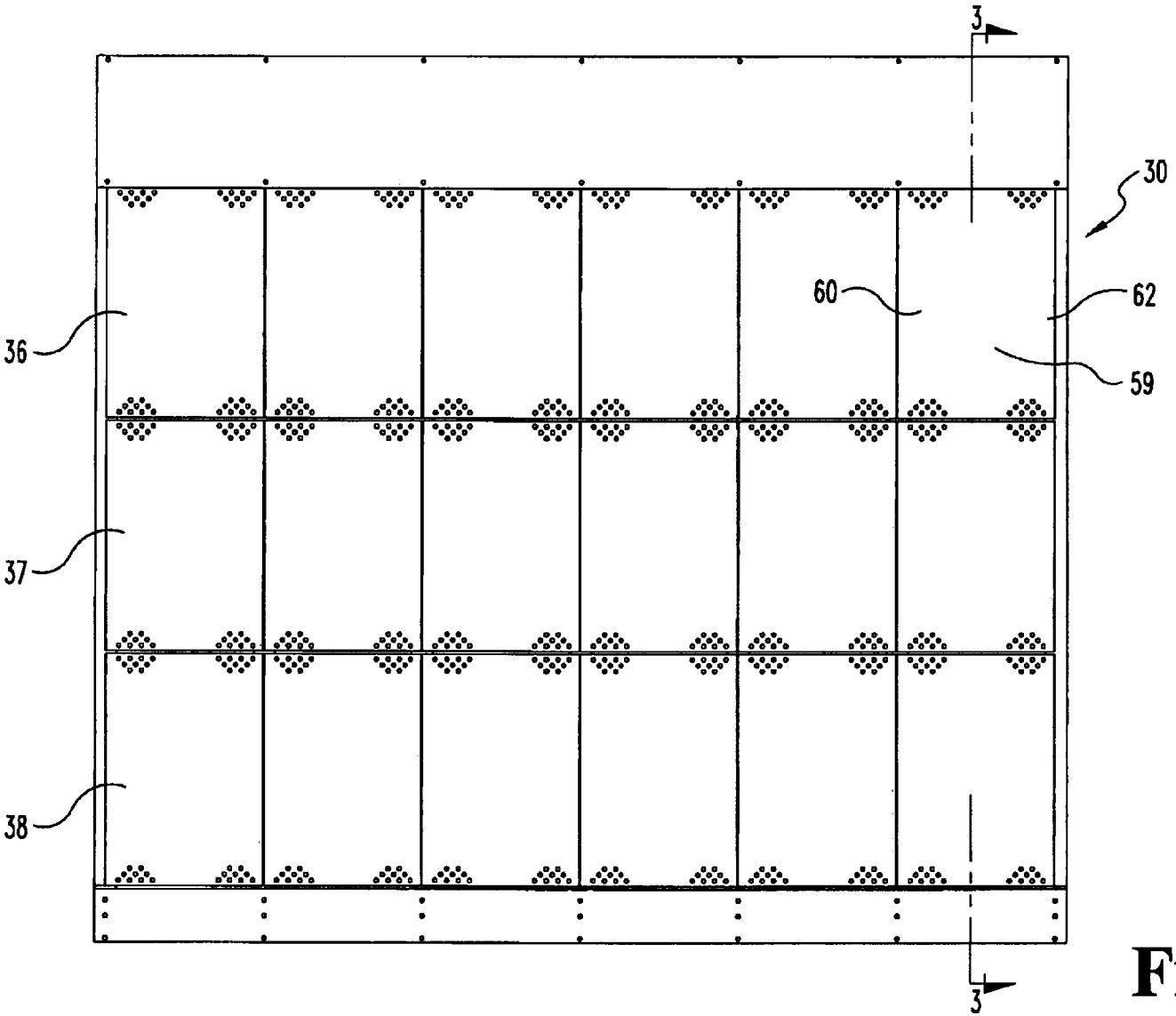
FIG. 2 is a front view of the apparatus for dispensing propane filled tanks.
Figure 3:
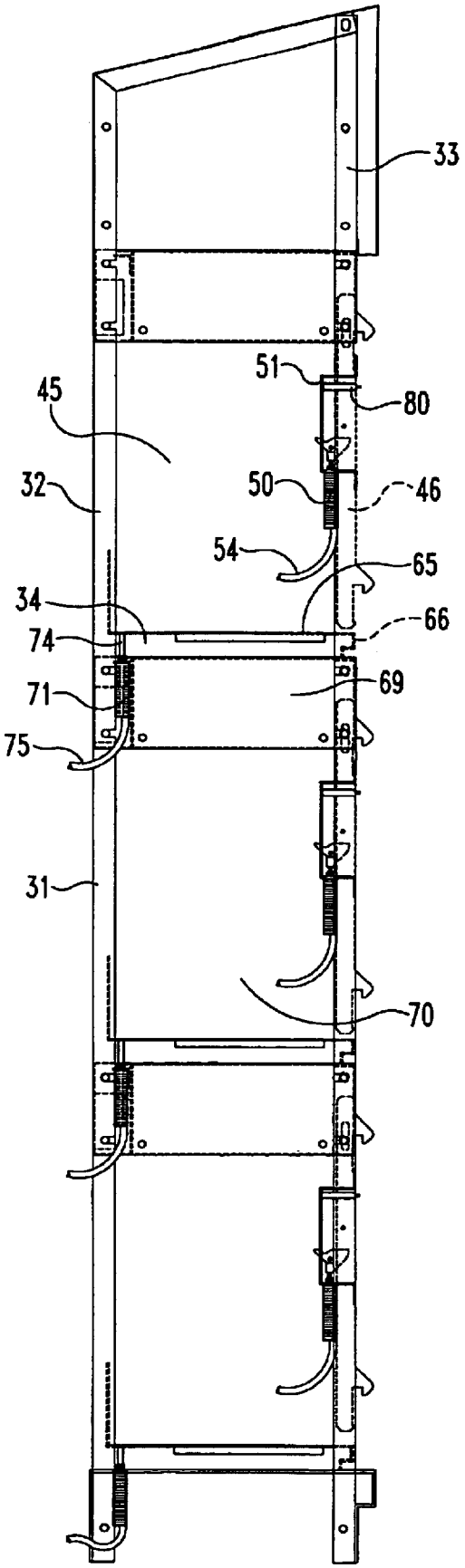
FIG. 3 is an enlarged cross-sectional view of three lockers taken along a line and viewed in the direction of arrows 3—3 of FIG. 2.
Figure 4:
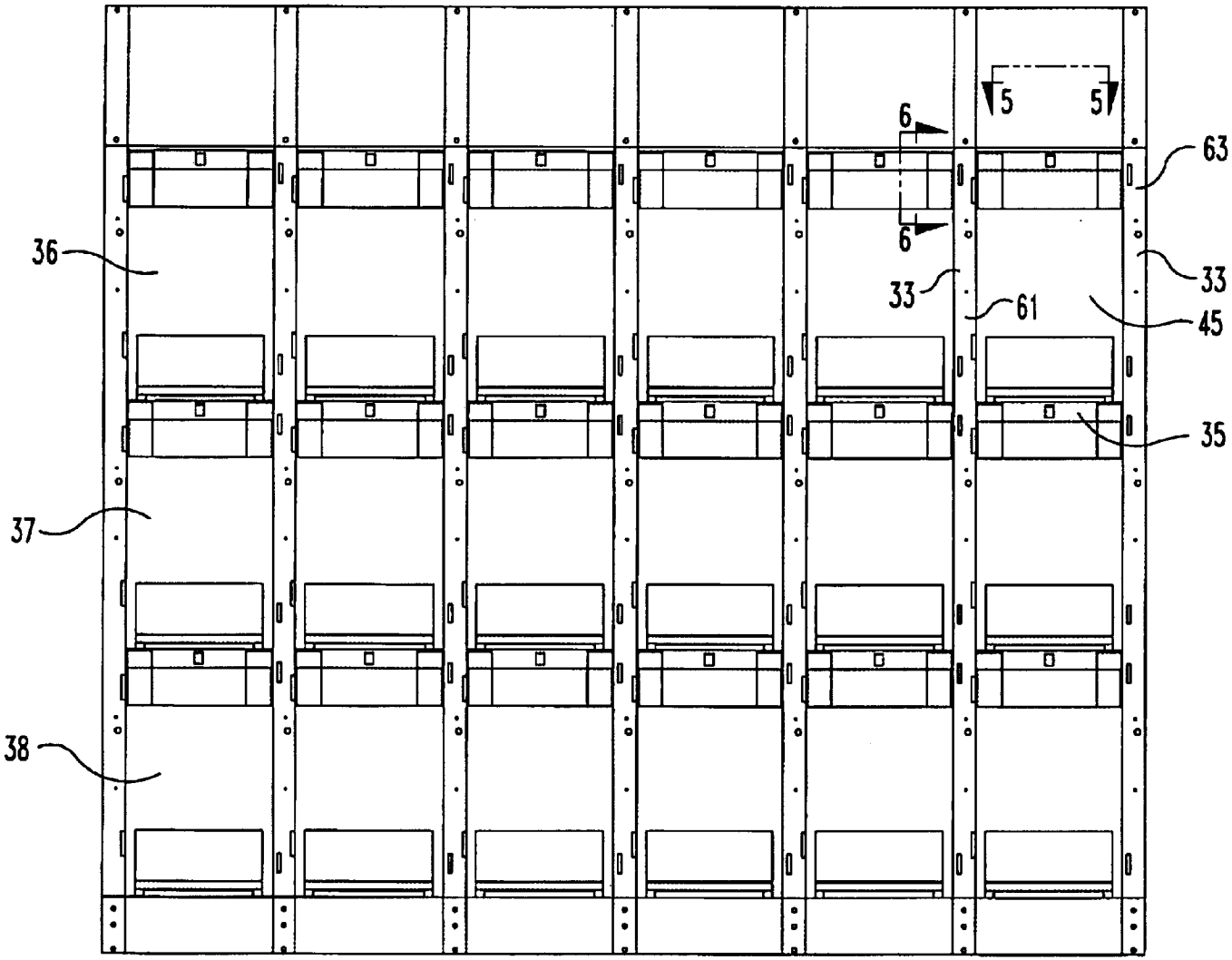
FIG. 4 is the same view as FIG. 2 with the exception that the doors to the lockers have been removed to illustrate the compartments.

Referring now more particularly to FIGS. 2 and 3, there is shown an apparatus for dispensing the propane filled tanks of FIG. 1 and for receiving empty tanks. Apparatus 30 includes a main frame 31 consisting of a plurality of upright rear members 32 and upright front members 33 fixedly secured together by a plurality of cross members 34 that extend between the rear members 32 and front members 33. Further, a plurality of cross-members 35 (FIG. 4) extend between and are connected to adjacent members 33. Members 32–35 form a rigid upright frame forming a plurality of identical compartments 36–38 (FIG. 4) arranged in vertical and horizontal rows. Thus, in the embodiment illustrated in FIG. 4, three horizontal rows are illustrated having respectively compartments 36, 37 and 38 provided therein. In addition, the embodiment illustrated in FIG. 4 shows a total of six vertical rows. One such vertical row is shown as having compartments 36, 37 and 38 therein. The present invention contemplates and includes an arrangement of compartments having more than or less than the number of compartments illustrated in FIG. 4.

Figure 5:
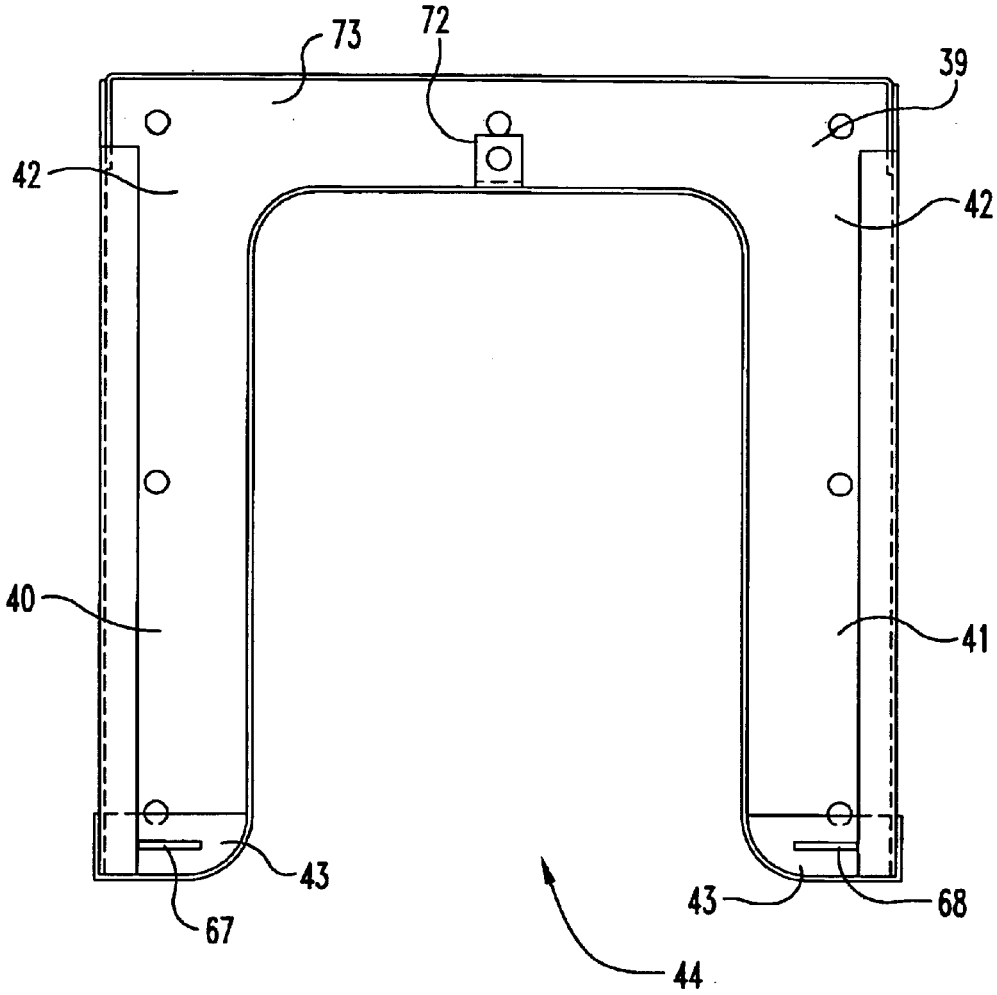
FIG. 5 is an enlarged top view of one of the locker collars looking in the direction of arrows 5—5 of FIG. 4.

A collar 39 (FIG. 5) is provided in the top portion of each compartment to receive the top outlet end of a tank, such as tank 20 (FIG. 1). Collar 39 is fixedly secured to frame 31 by being attached to the upright members 32 and 33 and cross members 34 and 35. Collar 39 consists of a pair of forwardly extending arms 40 and 41 joined together at their proximal ends 42 but having their distal ends 43 spaced apart forming a mouth 44 located at the front of each compartment. Arms 40 and 41 are spaced apart a distance slightly greater than the diameter of top wall 24 (FIG. 1). Since the collars are located in the top portion of each compartment, tank 20 may be inserted into a compartment only when it is in the upright position since wall 24 will fit between arms 40 and 41 whereas the bottom wall 22 of the tank is larger than the spacing between arms 40 and 41.

Figure 7:
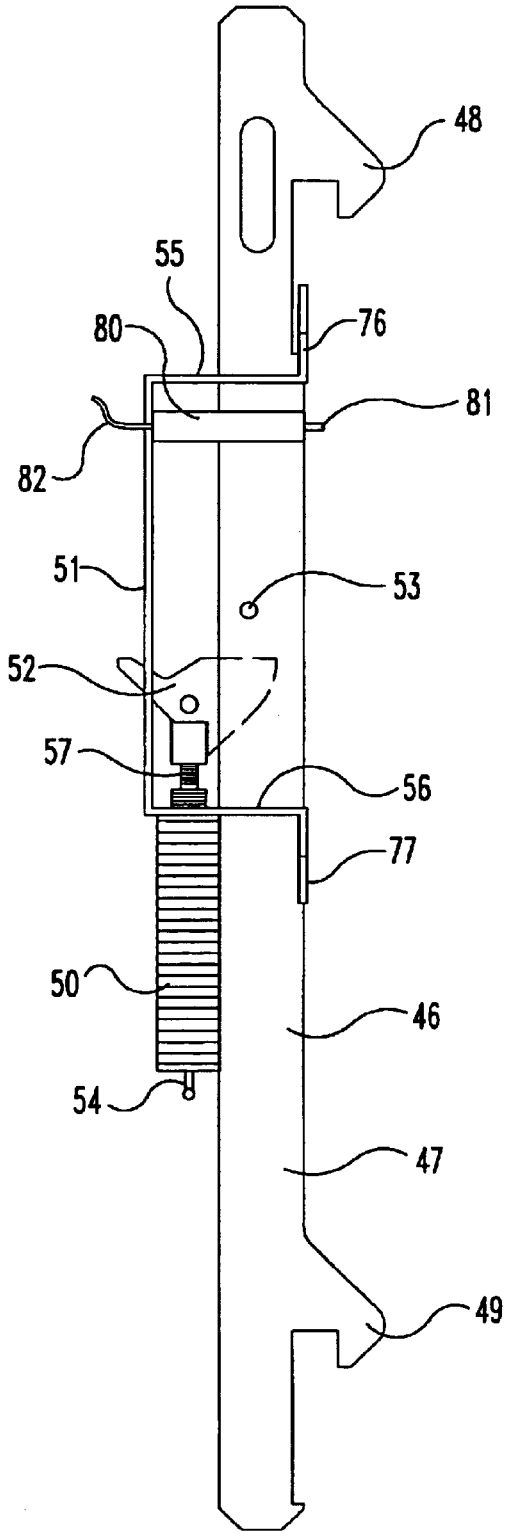
FIG. 7 is an enlarged side view of one of the door locks.

A fluid operated door lock is associated with each compartment to releasably lock the compartment door. The door lock associated with compartment 45 (FIG. 3) will now be described it being understood that an identical description applies to the door locks for the remaining compartments. Lock 46 (FIG. 7) includes an elongated main body 47 having a pair of downwardly opening and outwardly extending hooks 48 and 49 formed thereon. Main body 47 is slidable through a pair of slots formed in the upper wall 55 and lower wall 56 of bracket 51 having a pair of distal ends 76 and 77 fixedly attached to frame 31. A fluid cylinder 50 is attached to bracket 51 and has a fluid line 54 in fluid communication with a source of pressurized fluid. The piston outer end 57 of cylinder 50 is mounted to an enlarged ratchet end 52 initially spaced apart from rod 53 extending perpendicularly through main body 47. Upon activation of cylinder 50, end 52 is caused to move upwardly, as viewed in FIG. 7, contacting rod 53 and causing hooks 48 and 49 to move upwardly thereby releasing the door associated with the compartment.

A separate door is hingedly mounted to frame 30 adjacent each of the compartments formed by the frame 30. Door 59 will now be described it being understood that an identical description applies to all doors of the dispenser. Door 59 has a vertically extending left end 60 (FIG. 2) hingedly mounted by conventional means to one of the front upright members 33 and in the case of compartment 45 is mounted to the upright 61 (FIG. 4) extending along the left side of compartment 45. The right vertically extending edge portion 62 of door 59, as viewed in FIG. 2, is positioned adjacent the right upright 33 when the door is closed. The inwardly facing surface of the right edge portion 62 of door 45 includes a pair of slots to receive hooks 48 and 49. The pair of slots are aligned with hooks 48 and 49 when lock 46 is in the upward position corresponding to when the door is open. The slots are mis-aligned with respect to the hooks when the door is in the closed position thereby allowing hooks 48 and 49 to extend into the slots and downwardly trap the door wall within the hooks securing the door in the closed position. Upon pressurization of cylinder 50, hooks 48 and 49 are caused to move upwardly thereby disengaging the slots on the inwardly facing surface of door 59 and allowing the door to be opened and the tank removed from compartment 45. A suitable spring mechanism may be provided on the hinge mounting of the door to bias the door in the open position once the door lock cylinder 50 is pressurized.

Figure 6:
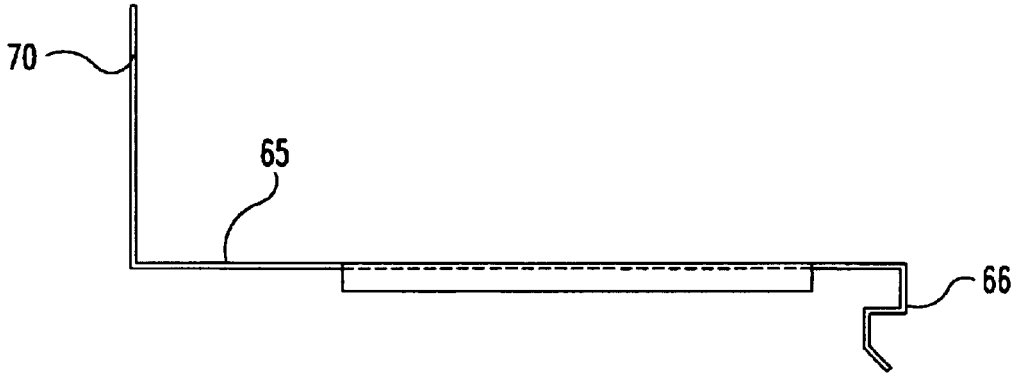
FIG. 6 is an enlarged side view of the floor of a locker looking in the direction of arrows 6—6 of FIG. 4.

The floor of each compartment includes a plate that is pivoted about its front end and mounted to the collar beneath the floor. Beneath the floor is a fluid sensor cylinder 71 with an outwardly extending cylinder shaft movable by an internal piston to detect the position of the floor depending upon the absence or presence of a tank atop the floor and depending upon whether the tank is filled or unfilled. For example, movable floor 65 (FIG. 3) is positioned in the bottom portion of compartment 45 and has a pair of downwardly extending front legs 66 (FIG. 6) that respectively extend into slots 67 and 68 (FIG. 5) provided in the distal ends 43 of collar 69 (FIG. 3) located immediately beneath compartment 45 and in the top portion of compartment 70. Floor 65 may be pivoted about ends 66 depending upon the absence or presence of a tank. The rear wall 70 of floor 65 extends upwardly to prevent the tank from slipping off the back portion of the floor. When a filled tank is present in compartment 45, the floor extends horizontally as illustrated in FIG. 3. Upon removal of a tank from compartment 45, floor 65 pivots in a clockwise motion as viewed in FIG. 3 about a pivot location corresponding to the location of front legs 66 to most a upward position. In the event an empty tank is inserted into compartment 45 then the floor will pivot downward in a counterclockwise direction about legs 66 as viewed in FIG. 3 to an intermediate position between the upward position and the horizontal position. If a filled tank is inserted back into the compartment then the floor will pivot back to the horizontal position. The floor is biased to the upward position by the cylinder shaft of weight sensor 71 corresponding to when the compartment is empty but yieldable to allow the floor to pivot downwardly as described.

A fluid cylinder 71 (FIG. 3) is mounted by bracket 72 to the cross portion 73 (FIG. 5) extending between the two collar arms 40 and 41 of the collar 69 located beneath the floor. Cylinder 71 includes an outwardly extending piston end 74 (FIG. 3) that is engageable by the bottom surface of floor 65 to detect if the floor extends horizontally corresponding to when a filled tank is inserted into compartment 45 or extends in a most upward position corresponding to a vacant compartment, or extends in an intermediate position corresponding to when an empty tank is inserted into compartment 45 atop floor 65. A fluid line 75 extends from cylinder 71 and is connected to a source of pressurized fluid.

A door sensor is mounted to the frame adjacent each door to detect whether the door is closed or opened. For example, fluid door switch 80 (FIG. 7) is mounted to bracket 51 and has an outwardly extending piston end 81 with end 81 being depressed once the door associated with the compartment closes. The opposite end of cylinder switch 80 is connected by fluid line 82 to a source of pressurized fluid.

Figure 8:
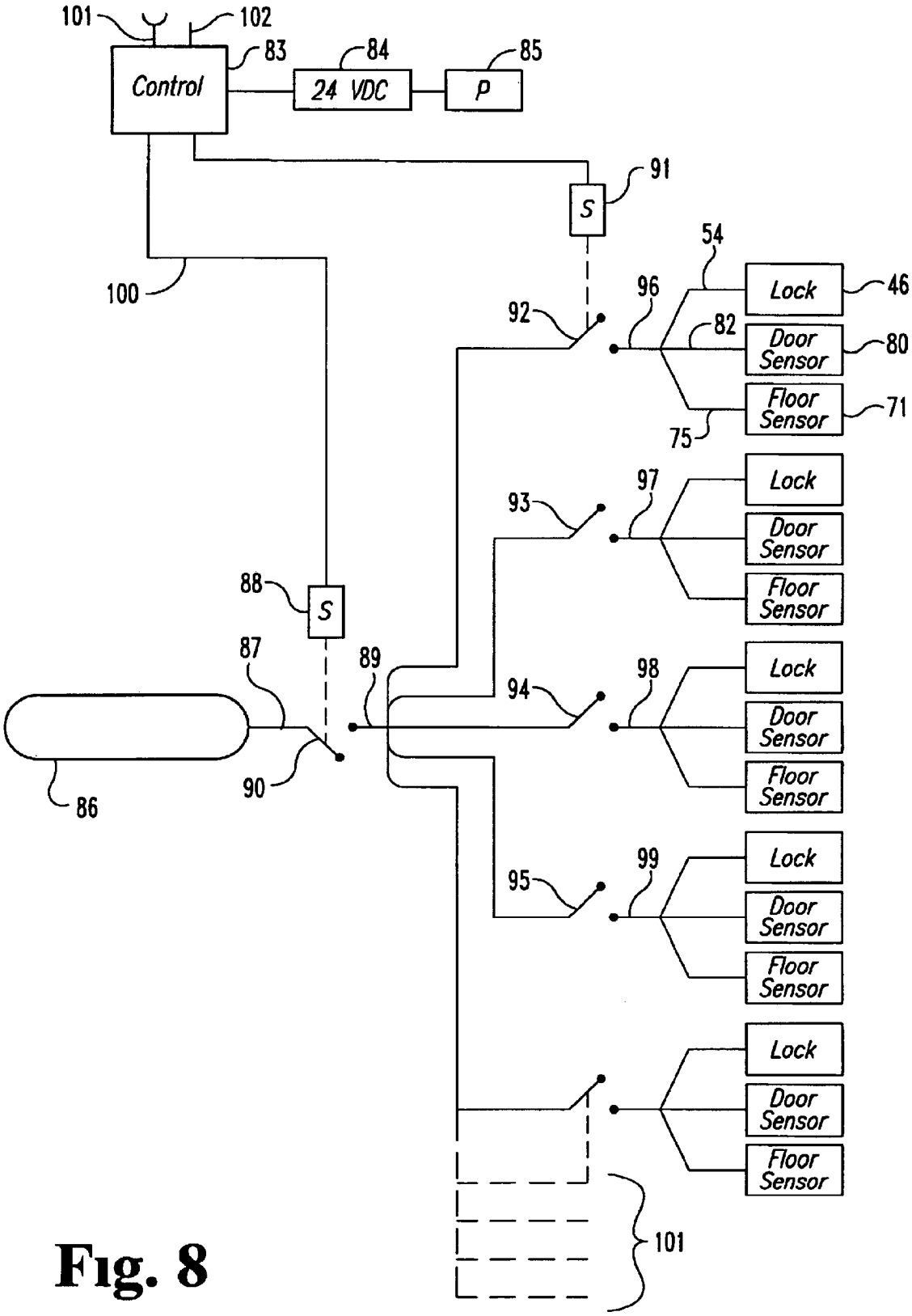
FIG. 8 is a simplified flow diagram illustrating the control system for operating the apparatus for dispensing tanks.

A conventional computerized control 83 (FIG. 8) is powered by a 24 volt DC source of electrical energy 84, in turn, powered by a battery source or alternating current source 85. Control 83 along with electrical sources 84 and 85 are located remotely from the cabinet 30 having the multiple storage compartments. A conventional nitrogen tank 86 is connected via a fluid line 87 to fluid line 89. A conventional electrical solenoid 88 is connected via electrical line 100 to control 83 and is operable to close and open valve 90 to allow the pressurized fluid or gas within tank 86 to flow to fluid line 89. Line 89 splits into a plurality of fluid lines with each line running to a separate compartment. For example, four such lines 96–99 are depicted in FIG. 8; however, it is to be understood that the number of lines branching off from line 89 corresponds exactly to the number of compartments or lockers for storing the individual smaller tanks. A separate solenoid is provided for each line associated with each compartment with the solenoids electrically connected to control 83 for closing and opening the valves associated with each compartment. Further, each line splits into three separate fluid lines connected to the fluid operated lock, door sensor and floor sensor associated with each locker. For example, fluid operated lock 46, door sensor 80 and floor sensor 71 associated with compartment 45 have respectively fluid lines 54, 82 and 75 connected together and to fluid line 96. Valve 92 is positioned between lines 96 and 89 with valve 92 closed and opened by solenoid 91. In a similar manner, the remaining compartments have door locks, door sensors and floor sensors connected to one of the fluid lines, in turn, connected to line 89. For example, lines 97–99 are connected to line 89 with valves 93–95 being separately controlled by solenoids operated by control 83. Additional lines 101 are provided for the remaining compartments and are connected via fluid valves to line 89.

In the preferred embodiment, control 83 includes a conventional credit card reader. Upon the standard authorization received through use of the credit card, control 83 is operable to activate solenoid 88 operating valve 90 to allow the pressurized gas, for example, nitrogen to flow from tank 86 through line 87 and then into line 89. Control 83 is further operable to operate a single solenoid associated with a particular locker to operate the associated valve to allow pressurized gas within line 89 to flow into the gas line associated with the particular selected locker. For example, if compartment 45 has been selected then control 83 operates solenoid 91 moving valve 92 to allow the pressurized gas to flow from line 89 to line 96 and simultaneously to lines 54, 82 and 75 thereby pressurizing lock 46, door sensor 80 and floor sensor 71. In the preferred embodiment, the line pressure is 30 psi. Once lock 46 is pressurized, main solenoid valve 88 closes, then the enlarged end 52 (FIG. 7) of cylinder 50 is caused to move upwardly thereby forcing hooks 48 and 49 upwardly disengaging door 59 and allowing the door to pivot open. Once the filled tank is removed from compartment 45, compartment floor 65 pivots upwardly being under 30 psi of gas (fluid) pressure to urge the floor to an upward position. As the floor is pivoted to its upward position, piston end 74 of sensor 71 moves upwardly thereby sensing that the floor has moved to its upward position corresponding to removal of the tank from the compartment As the piston outer ends of the cylinders associated with lock 46 and floor sensor 71 move outwardly, the volume within the pressurized line is increased thereby dropping the pressure in lines 96 and 89 from 30 psi to approximately 22 psi to 24 psi. The pressure within lines 89 and 96 is sensed by conventional pressure sensors with the information fed to control 83 telling the control that the door is in an open position and that the tank within compartment 45 has been removed. If an empty tank is inserted back into compartment 45, floor 65 pivots downward to an intermediate position whereas if a full tank is reinserted into the compartment the floor pivots down to its most downward horizontal position. Assuming an empty tank is placed back into the compartment, floor sensor 71 detects the floor at an intermediate pressure and position. By closing door 59, the piston distal end 81 is contacted by the door thereby depressing end 81. Door sensor 80 is a bleed gas valve allowing gas within sensor 80 as well as the line attached thereto to escape to the atmosphere through a precision-machined orifice to control the rate so long as the piston end is depressed. Once the pressure within line 82 (as well as lines 54, 75, 96 and 89) drops to 16 psi, the pressure is sensed and the information is provided to control 83 corresponding to the door being closed At that point, solenoid 91 is activated thereby disconnecting lines 54, 82 and 75 from line 89. Simultaneously, the customer's credit card is charged for the fill tank taken from the compartment less an amount corresponding to return of the empty tank inserted back into the compartment. If a tank is not placed back into the compartment and the door is closed, then the floor sensor 71 senses the floor being in the upward position with door sensor 80 bleeding off pressure within the line 96 informing the control 83 the door has been closed without a tank being inserted into the compartment. In such a case, the customer is charged for a full tank without any deduction normally allocated towards a returned tank.

Control 83 may be provided with a conventional computer memory to remember the specific compartments having filled propane tanks therein, the specific compartments that have empty propane tanks therein, and the specific compartments that do not have any propane tanks stored therein. Thus, control 83 may be programmed to open only a door associated with a compartment having a filled propane tank therein. Control 83 may be provided with a wireless modem and the attached antenna 101 and/or a ground line 102 to communicate the status of the system including the, number of filled tanks remaining to a remote location via the wireless modem and attached antenna to a satellite system and/or via line 101 by conventional telephone lines. A suitable wireless modem is included within control 83 for sending and receiving the information.

A feature of the propane tank dispenser is the ability for the dispenser to be placed in remote or rural locations. This adaptation is achieved by using wireless communication technology rather than the standard hard line telephones for the purchaser authorization process. In other words, the wireless modem and attached antenna 101 (FIG. 8) is used to communicate with a central server at the purchaser authorization center. By combining a battery operated, solar recharged power source, with a wireless communication device, the dispenser can be set at a campground, State Fair, or other temporary event without the need to have utilities connected. In such a case, source 85 is a solar charged battery unit.

The machine is mounted on a roll-on/roll-off base designed as an oil field skid, thereby, allowing quick transportation, off loading, leveling, filling with full propane tanks and activated for immediate operation. The reverse process gives the dispenser the ability to be moved to a new location with a minimal effort. With no utilities to disconnect or cumbersome un-insulation, the dispenser is designed as portable as many other vending machines used in temporary events.

In the preferred embodiment, control 83 along with power sources 84 and 85 and all of the solenoids and valves are located remotely in order to conform to all national, state, local and international codes requiring any ignition source at least five feet from the propane cylinders. Thus, the user is able to operate the system and then walk to the particular locker whose door has opened providing an orderly sequence. The fluid lines that extend between the solenoid operated fluid valves to the door switches, weight sensors and locks provide the sole control communication between the lockers and control 83.

The method of dispensing the propane tanks includes the step of providing a plurality of lockers to hold the propane tanks and a control apparatus remotely located from the lockers to control the door locks, tank sensors and door sensors associated with each locker. The method includes the further step of inserting a plurality of filled propane tanks, one each, into each of the lockers with the door for each locker then being closed. An unlocking command is sent via the fluid line to the lock on the door associated with the particular locker to be opened. The propane tank is then removed from the particular locker with data in the form of reduced pressure being sent to the control apparatus via the fluid line corresponding to whether a tank is absent from the particular locker or an unfilled tank is present in the locker. In the event a filled tank is present in the locker then the pressure remains constant. Likewise, the method includes sending data in the form of reduced pressure via the fluid line from the door sensor corresponding to the door being open for a particular locker. Once a particular line is pressurized, the pressure within the line is kept at a constant level or pressure as the door is opened. The same line which is also connected to the tank sensor or floor location sensor is kept at a constant pressure after the door is opened until a tank is removed from the particular locker. In addition, the same line connected to the tank sensor is kept at a constant pressure after the tank is removed from the particular locker until a tank is reinserted into the particular locker and the door is not closed. Once the door is closed, the pressure in the line is reduced by the door sensor bleeding off the pressure.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A dispenser of tanks, said tanks have top dispensing ends, comprising:

a cabinet with multiple storage compartments to store and dispense filled tanks and to receive and store empty tanks, said compartments each being sized to receive a single tank;

a plurality of doors hingedly mounted to said cabinet and movable to and from open positions allowing access to said compartments and closed positions limiting access to said compartments;

a plurality of fluid operated locks associated with said doors and said cabinet releasably locking said doors in said closed positions; and, a fluid control apparatus located remotely from said cabinet and connected to said locks to unlock via fluid said fluid operated locks allowing said doors to move to said open positions.

2. The dispenser of claim 1 and further comprising:

a plurality of brackets mounted within said compartments and being sized to receive the dispensing ends of tanks to limit insertion of said tanks into said compartments with only said top dispensing ends in an upward position.

3. The dispenser of claim 1 wherein said fluid control apparatus includes:

a source to hold pressurized fluid located remotely from said cabinet and in communication with said locks;

a plurality of fluid valves operably connected between said source and said locks to direct pressurized fluid from said source to said locks for activation of said locks; and, an authorization device connected to said valves to control operation thereof.

4. The dispenser of claim 1 and further comprising:

a plurality of weight sensors, one for each compartment, to sense presence of a filled tank, presence of an empty tank, and absence of a tank within a compartment, said weight sensors being in fluid communication with said control apparatus.

5. The dispenser of claim 1 and further comprising:

a plurality of door switches, one for each compartment, to detect the positions of said plurality of doors, said door switches being in fluid communication with said control apparatus.

6. The dispenser of claim 5 wherein said control apparatus includes:

a source of pressurized fluid located remotely from said cabinet and in fluid communication with said locks;

a plurality of fluid valves operable connected to said source and said locks to direct pressurized fluid from said source to said locks for activation of said locks; and, an authorization device connected to said valves to control operation thereof.

7. The dispenser of claim 6 and further comprising:

a plurality of weight sensors, one for each compartment, to sense presence of a filled tank, presence of an empty tank, and absence of a tank within a compartment, said weight sensors being in fluid communication with said control apparatus.

8. The dispenser of claim 7 and further comprising:

fluid lines extending between said control apparatus and said door switches, said weight sensors, and said locks and providing the sole control communication therebetween.

9. The dispenser of claim 8 wherein:

each of said weight sensors operable to reduce fluid pressure in a fluid line extending between said weight sensors to said control apparatus corresponding to the presence of an empty tank, and absence of a tank within a compartment.

10. The combination of:

a plurality of tanks with top ends with outlets;

a frame forming a plurality of individual lockers each for holding one of said tanks;

a plurality of doors mounted to said frame adjacent each of said lockers and having closed positions limiting access to said lockers and open positions allowing access to said lockers;

fluid operated locks mounted to said frame and engageable with said doors to lock said doors in said closed positions;

fluid operated sensors mounted to said frame for each of said lockers to detect the absence of tanks positioned within said lockers;

a source of pressurized fluid;

a plurality of fluid lines extending from said locks and said sensors to said source of pressurized fluid; and, a control apparatus upon command to control fluid flow to said locks for activation thereof and to receive data from said fluid operated sensors for determination of the presence of a filled tank, presence of an empty tank, and absence of a tank within a locker.

11. The combination of claim 10 wherein:

said lockers each have a top portion and a bottom portion, said sensors include floors movably mounted at said bottom portion and movable between a lower position corresponding to when a filled tank rests thereatop, an intermediate position corresponding to when an empty tank rests thereatop and an upward position corresponding to when a tank is not positioned thereatop, said sensors are floor location sensors mounted to said frame adjacent each of said floors, said floor location sensors sensing if said floors are in the lower position, intermediate position, or upward position and providing sensing data via said fluid lines to said control apparatus.

12. The combination of claim 11 and further comprising:

a plurality of collars mounted to said frame within said lockers, said collars are located in said top portion of each of said lockers and are sized to receive the top ends of said tanks limiting insertion of said tanks into said lockers when only said tanks are upright locating said outlets thereatop.

13. The combination of claim 12 and further comprising:

a plurality of switches mounted to said frame for each of said lockers and located adjacent said doors to detect when said doors are closed or open, said switches connected via said fluid lines to said control apparatus to provide sensing data as to whether said doors are closed or open.

14. A method of dispensing tanks having top ends comprising the steps of:

providing a plurality of lockers to hold a plurality of tanks, each of said lockers having a door, a fluid operated door lock, a fluid operated tank sensor, and a fluid operated door position sensor;

providing a control apparatus remotely from said lockers, said control apparatus having fluid lines connected to said door lock, said tank sensor and said door position sensor for said lockers;

inserting a plurality of filled tanks, one each, into said plurality of lockers;

closing said door for each of said plurality of lockers;

pressurizing a fluid line extending from said control apparatus to said door lock, said tank sensor, and said door position sensor corresponding to a particular locker;

sending an unlocking command via said fluid line from said control apparatus to said fluid operated lock on a door associated with said particular locker to open the door;

removing a tank from said particular locker; and, sending data to said control apparatus via said fluid line connected to fluid operated tank sensor of said particular locker corresponding to whether a tank is absent from said particular locker or an unfilled tank is present in said particular locker.

15. The method of claim 14 and further comprising the step of:

sending data to said control apparatus via said fluid line connected to said fluid operated door position sensor corresponding to said particular locker.

16. The method of claim 15 and further comprising the steps of:

after said pressurizing step, keeping said line connected to said door lock corresponding to a particular locker at a constant pressure until said door is open;

keeping said line connected to said tank sensor corresponding to a particular locker at a constant pressure after said door is open until a tank is removed from said particular locker; and reducing said pressure in said line connected to said door position sensor corresponding to a particular locker once the corresponding door is closed.

* * * * *